United States Patent [19]

Ginzburg et al.

[11] Patent Number: 4,683,744

[45] Date of Patent: Aug. 4, 1987

[54] FLEXIBLE EDGE ROLL

[75] Inventors: Vladimir B. Ginzburg; Naum M. Kaplan, both of Pittsburgh, Pa.

[73] Assignees: Wean United Rolling Mills, Inc.; International Rolling Mill Consultants, Inc., both of Pittsburgh, Pa.

[21] Appl. No.: 746,376

[22] Filed: Jun. 18, 1985

[51] Int. Cl.[4] ..... B21B 27/02; B21B 31/32

[52] U.S. Cl. ..... 72/243; 29/113 AD; 72/8; 72/11; 72/13; 72/16; 72/17; 72/245; 72/247

[58] Field of Search ..... 72/243, 241, 242, 247, 72/20, 8, 11, 13, 16, 17; 29/113 R, 113 AD, 116 R, 116 AD, 117; 100/162 B

[56] References Cited

U.S. PATENT DOCUMENTS

| | | | |
|---|---|---|---|
| 3,355,924 | 12/1967 | Sendzimir | 72/241 |
| 3,457,617 | 7/1969 | Noe | 29/113 R |
| 4,059,976 | 11/1977 | Christ | 72/241 X |
| 4,062,096 | 12/1977 | Eibe | 29/113 AD |
| 4,074,624 | 2/1978 | Biornstad et al. | 72/243 X |
| 4,089,094 | 5/1978 | Kaira | 29/116 AD |
| 4,106,405 | 8/1978 | Biondetti et al. | 72/243 X |
| 4,242,781 | 1/1981 | Takigawa et al. | 29/113 AD |
| 4,319,522 | 3/1982 | Marchioro et al. | 72/245 X |
| 4,481,799 | 11/1984 | Glattfelder et al. | 72/243 X |
| 4,602,408 | 7/1986 | Noe et al. | 29/113 AD |

FOREIGN PATENT DOCUMENTS

| | | | |
|---|---|---|---|
| 0086606 | 6/1980 | Japan | 72/243 |
| 0133805 | 10/1980 | Japan | 72/247 |
| 0068206 | 4/1982 | Japan | 72/243 |
| 0054401 | 3/1984 | Japan | 72/243 |
| 2132122 | 7/1984 | United Kingdom | 72/242 |

*Primary Examiner*—Robert L. Spruill
*Assistant Examiner*—Steve Katz
*Attorney, Agent, or Firm*—Suzanne Kikel

[57] ABSTRACT

A rolling mill arrangement having at least one roll carrying a sleeve forming a cavity with the roll body near the two opposed ends of the roll. Pressurized fluid is regulated in these cavities to counteract "edge drop" which occurs at the edges of a product under the conventional procedures for controlling the mill for effecting control of the edge thickness of the strip when reducing the product along its width.

10 Claims, 9 Drawing Figures

PRIOR ART

FLEXIBLE EDGE ROLL

BACKGROUND OF THE PRESENT INVENTION

This invention relates to a roll construction whereby pressurized fluid is introduced near the edges thereof to vary the effective rigidity while maintaining a constant rigidity in the crown area. More particularly, in order to obtain a more uniform thickness across the width of a rolled product, the rolling pressure is particularly controlled near the ends of the product.

In conventional multiple rolling mills, it is customary to effect control of the thickness and shape of a product being rolled by performing one or a combination of several well-known methods, such as correcting the deflection of the work rolls or the back-up rolls by providing counter roll bending forces between these rolls, and/or providing a crown on the work rolls in addition to providing quick acting screw down device.

Normally when using these conventional methods, the profile of the product in a transverse direction consists of a crown in the center tapering off at both ends which is referred to in the industry as "edge drop" where the thickness near the ends of the product is less than that at its center.

This "edge drop" condition or over rolling essentially occurs for at least two reasons: one reason being that the effective rolling load near the edges of the product is greater than the rolling load in the center of the product thereby causing the rolls of the mill to deliver a greater force to the portions of the roll contacting the edges of the strip; and the other reason being there is more lateral spreading and therefore less resistance from the material near the ends of the product upon the application of the rolling forces of the rolls during the rolling process.

Several methods for reducing or eliminating the degree of this "edge drop" are known in the industry; for instance, tapering the ends of the work rolls; or shortening the back-up rolls when used in conjunction with work rolls; or axially shifting the work rolls or an intermediate roll especially in a five or six high roll arrangement.

There are several drawbacks to these above methods and/or their structural features for carrying out the respective methods. One drawback is that when tapering the roll ends or for shortening the work rolls, only a limited range of product width can be rolled. A drawback inherent in the axial shifting of one of the rolls is that the shifting operation normally can be done only in between the sequential rolling of products and not while the product is actually being rolled.

SUMMARY OF THE PRESENT INVENTION

It is therefore an object of the present invention to provide a roll construction which eliminates or reduces the "edge drop" phenomenon in creating thinner strip edges for a rolled product, resulting in a uniform thickness across the width of the product.

A further object of the present invention is to provide a roll construction in an arrangement for a rolling mill stand which will efficiently operate on a wide width range of products achieving a uniform edge thickness of the product and to operate while the product is being rolled in the mill.

More particularly, it is an object of the present invention to provide a construction for a roll comprising one or more cavities at at least one end of the roll wherein pressurized fluid is introduced to vary the effect of the working area at the cavity end thereby to reduce edge drop while maintaining a rigid working area at the center of the roll to produce an effect at the center of the product substantially equivalent to that produced by the above mentioned conventional practices for reduction of a product.

A still further object of the present invention is to provide in a rolling mill stand for reducing a workpiece having two opposed longitudinal surfaces having a center and two opposed edges, comprising; at least two work rolls, each said work roll arranged transversely of and having a working surface in contact with said workpiece along its width for working a different one of said two opposed longitudinal surfaces thereof, a back-up roll associated with each said work roll remote from said workpiece, said each back-up roll having a surface along its length substantially contacting said working surface of its an associated work roll and having a rigid central portion and opposed ends, at least one end of each back-up roll and arranged at opposed ends relative to each other having at least a partial annular chamber formed adjacent the roll end portions of said contacting surface and co-extensive with the associated edge of the workpiece, constructed and arranged in a manner to receive pressurized fluid when in an operative mode to cause said contacting surface adjacent said chamber of said back-up roll to apply a desired pressure against said work roll, and hence said opposed edges of said workpiece so as to effect a pressure distribution near said opposed edges of said workpiece which is less in value than that along said center of said workpiece which is applied by said rigid central portion of said back-up roll such as to reduce over rolling of the edges of said workpiece.

These and other objectives, features and advantages of the present invention will become more fully apparent from the following detailed description of the preferred embodiment, the appended claims, and the accompanying drawings in which;

DESCRIPTION OF THE PREFERRED EMBODIMENT

Figure 1:
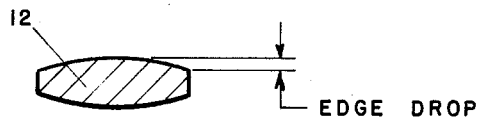
FIG. 1 is a schematic illustrating a profile of a product rolled according to the teachings of the prior Art practices.

FIG. 1 clearly illustrates the above mentioned condition known as "edge drop" or over rolling where in a transverse cross-section the profile of the strip consists of a crown being much greater in thickness than the ends thereof which taper off.

Figure 2:
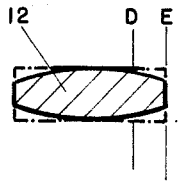
FIG. 2 is a schematic illustrating a profile in a product rolled according to the teachings of the present invention.

FIG. 2 shows by the dotted lines that the thickness at the ends of the strip in a transverse cross-section is substantially greater than that of FIG. 1, while a center crown in the strip still remains.

Figure 3:
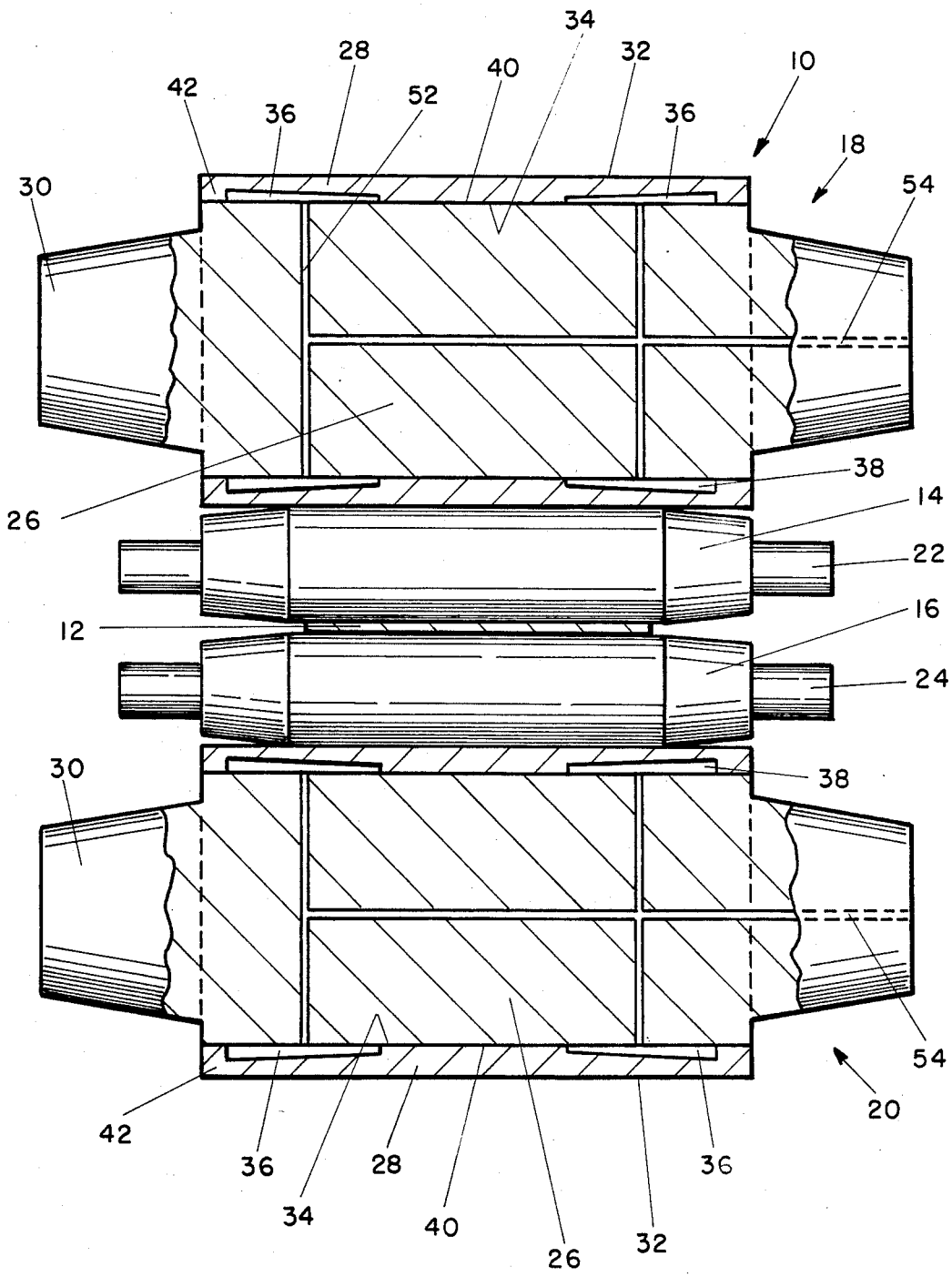
FIG. 3 is a schematic front elevational partly cross-sectional view of a four high rolling mill illustrating a first preferred embodiment of the present invention including a back-up roll construction.

Referring to FIG. 3, there is shown a four high roll arrangement 10 for a rolling stand in a hot or cold mill for rolling strip 12 such as steel or aluminum between two rotatable work rolls 14, 16 backed up by rotatable rolls 18, 20 respectively and which stand comprises known designs for a roll screw-down device and a roll bending device to effect control of the thickness and shape of strip 12. Work rolls 14, 16 are smaller in diameter than their respective back-up rolls 18 and 20 and as shown have cambered working surfaces which are greater in length than the width of strip, and tapered opposed end near neck portions which are received in chock bearings 22, 24 for direct rotation or rotation by back-up rolls 18 and 20. The construction of work rolls 14 and 16 are shown to be machined cambered, but the camber may be effected by one of many available methods known in the industry including the producing of a crown by introducing variable pressurized fluid into the center of the work rolls as exemplified by U.S. Pat. No. 3,457,617 issued on July 29, 1969.

The present invention particularly lies in the construction of back-up rolls 18 and 20 and its interrelationship with and affect on the work rolls in reducing strip 12 and, which construction for back-up rolls 18 and 20 may be one of the five preferred embodiments shown in FIGS. 3, 4, 5, 6, and 7.

Figure 7:
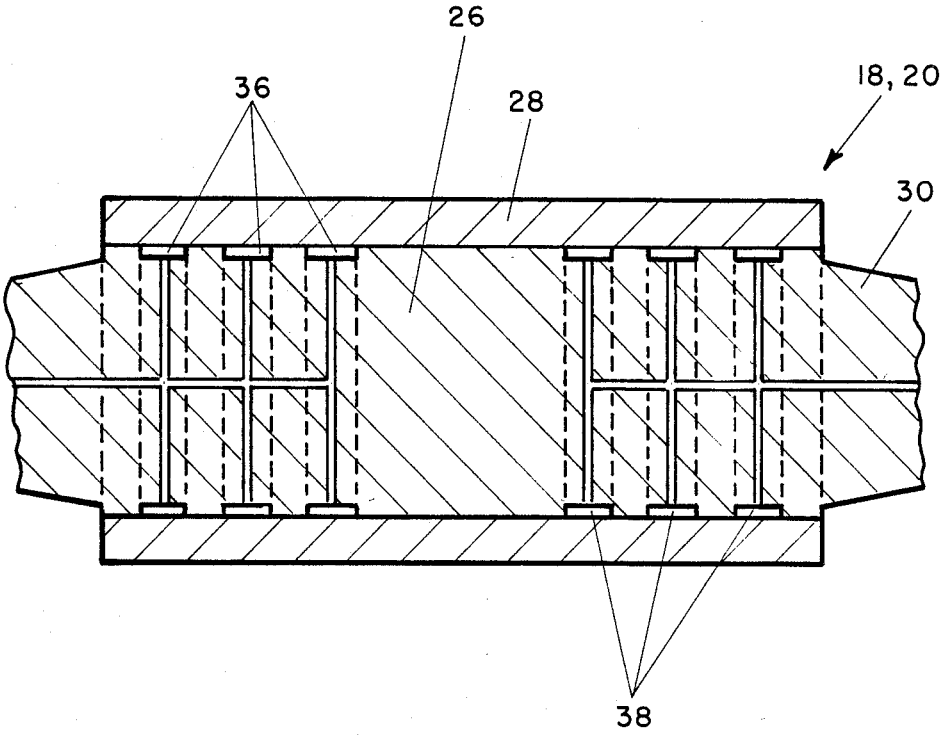
FIG. 7 is a partial cross-sectional schematic view illustrating a fifth preferred embodiment for a roll construction.

In these FIGS. 3, through 7, it is illustrated that back-up rolls 18 and 20 comprise a roll body 26 and an outer shell 28, with neck portions 30 rigidly and integrally connected to roll body 26 for their mounting in chock bearings (not shown) which along with the work rolls are conventionally carried by a roll stand of a rolling mill in order to be either directly or indirectly driven. Since both back-up rolls 18 and 20 are the same construction, only the upper back-up roll will be discussed in further describing the invention.

Figure 4:
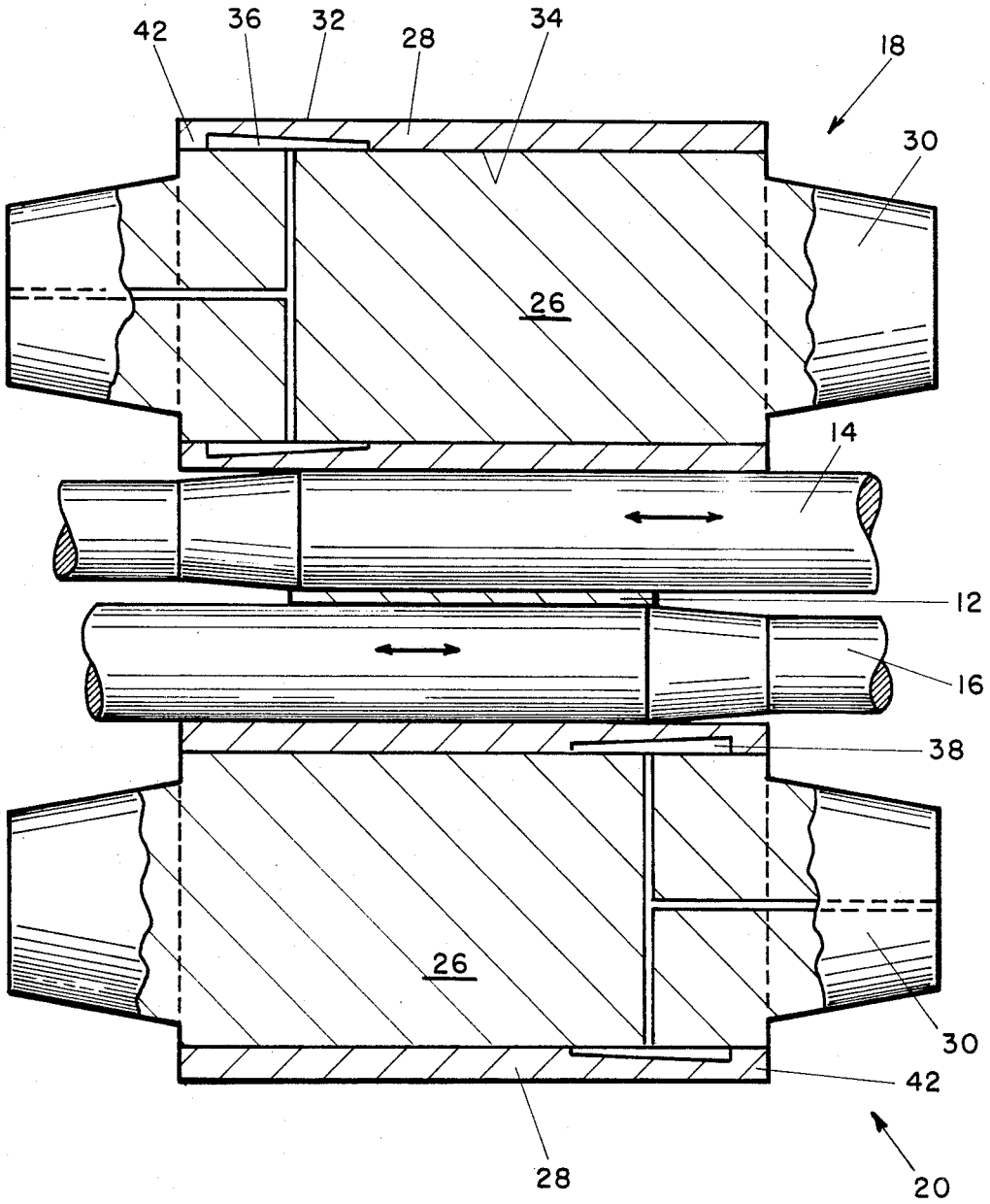
FIG. 4 is a schematic front elevational partly cross-sectional view of a four-high rolling mill illustrating a second preferred embodiment of the present invention including a back-up roll construction.

In FIGS. 3 and 4 shell 28 has an outer surface 32 which is generally straight across the length of roll body 26 and an inner surface 34. In FIGS. 3 and 4, inner surface 34 has an indented area 36 located along one edge as shown in FIG. 4 or two of the opposed edges as shown in FIG. 3 of roll body 26, which indented area 36 in conjunction with a circumferential surface area of roll body 26 forms an annular chamber or cavity 38 around roll body 26. As shown in FIG. 3 adjacent to outer surface 32 of shell 28 contiguous to annular chambers 38 but the two opposite edges of rolls 18, 20 is a rigid central portion 40 and rigid end portions 42 formed in the inner surface 34 of shell 28 which portions 40 and 42 abut the outer surface of roll body 26. As shown in FIG. 4, each roll 18, 20 has a rigid end portion 42 where inner surface 34 extends substantially along the length of the rolls. The shell may be secured to the body by a shrink or pressure fit in a tight fit to avoid the escapement of hydraulic fluid from the chambers 38.

As the embodiments in FIGS. 3 and 4 illustrate, the area of annular chamber 38 near rigid end portions 42 is greater and descends in a tapering fashion toward the center of roll body 26.

The chambers 38 of back up rolls 18, 20 are also arranged to be coextensive with the straight and tapered portions of the associated work roll 14, 16 respectively, and are arranged midway between where the tapered and straight surfaces of the work roll unite, the result being advantageous controlling deflection of the edges of the work roll in the "edge drop" area.

As FIG. 7 shows, there may be several annular chambers 38 located toward the ends of rolls 18, 20 where roll body 26 is machined into camfered indentations 36 along its length, and sleeve 28 is shrink-fitted over roll body 26. Even though not shown in FIG. 7, an axial passageway is provided whereby a radial passageway branches off from the axial passageway and extends into each chamber 38 slmilarly to that shown in FIGS. 3-6 for supplying the same or different pressurized fluid therein to thereby be able to obtain a particular edge drop deflection curve.

In FIG. 4, work rolls 14, 16 are shifted along their longitudinal axes predetermined small increments in opposite directions to allow for greater work roll wear life. In FIG. 4 only one end portion of back-up rolls 18, 20 contains an annular chamber 38 which are oppositely arranged relative to each other for receiving pressurized fluid, which chambers 38 are located to co-extend with the tapered end portion of work roll 14, 16. As can be seen in FIG. 4, an extended working surface of each work roll 14, 16 is always available to contact the end portion of strip 12 on one side thereby to allow for the small axial incremental movement of the work rolls as dictated by the overlap of the strip and roll at the opposite end of the work roll.

Figure 6:
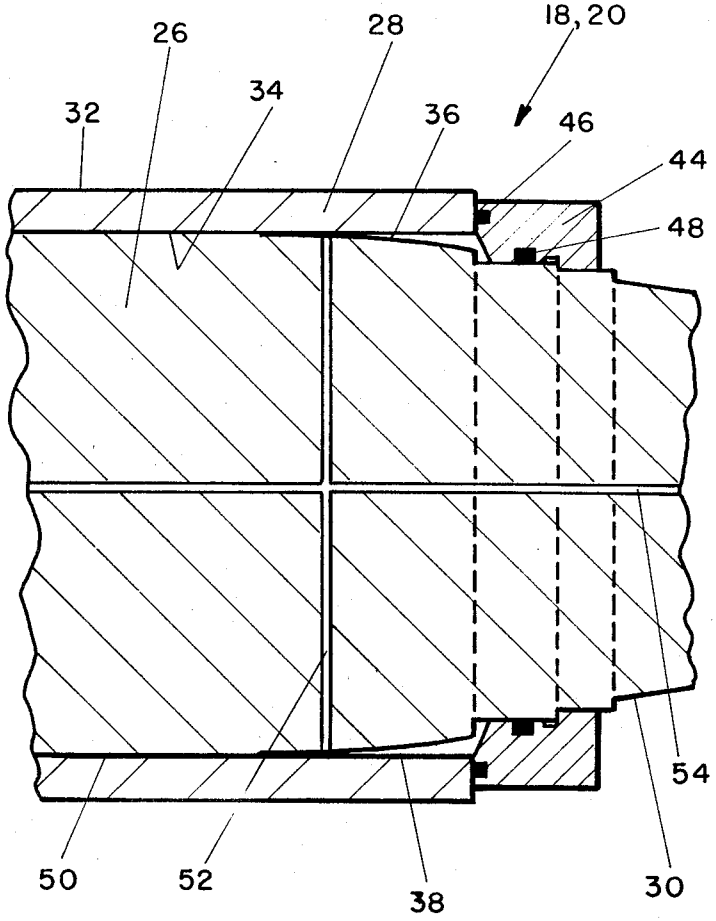
FIG. 6 is a partial cross-sectional schematic view illustrating a fourth preferred embodiment for a roll construction.
Figure 5:
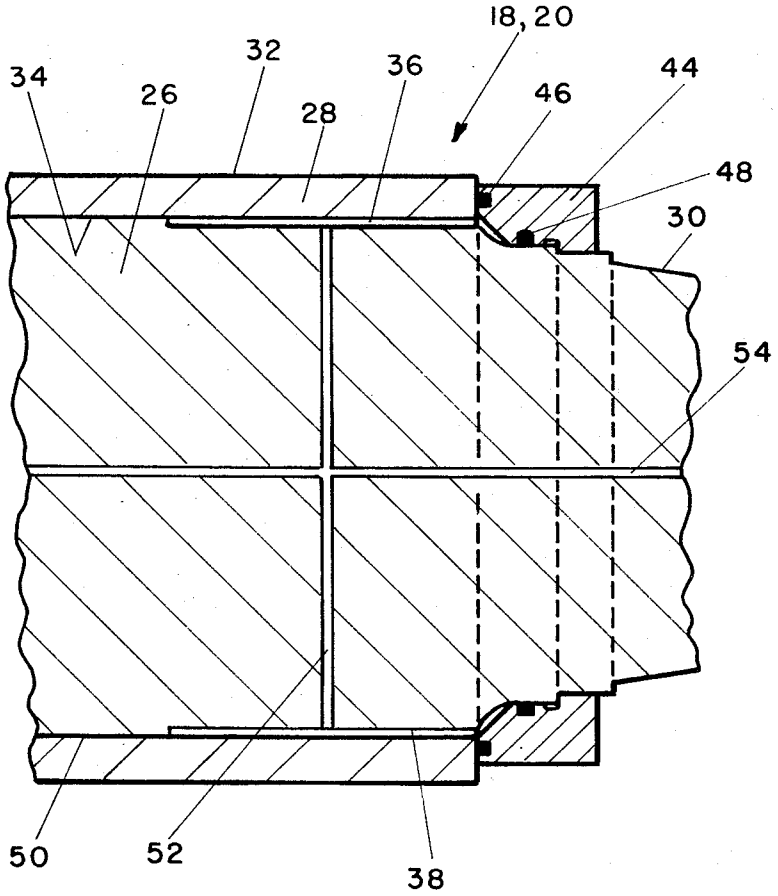
FIG. 5 is a partial cross-sectional schematic view illustrating a third preferred embodiment for a roll construction.

FIGS. 5 and 7 show that the configuration for annular chambers 38 may be cylindrical or as FIGS. 3, 4 and 6 show it may be parabolic. In the latter case, the length of contact zone between shell 28 and roll body 26 increases with an increase of load transmitted from the work roll 14, 16 thereby providing increased rigidity of the shell 28. These annular chambers 38 in FIGS. 5 and 6 as are those of FIG. 7 are cut into roll body 26 and are formed by the cooperation of shell 28 with collar 44 mounted on each neck portion 30 (only one shown) of roll body 26. An annular sealing element 46 abuts shell 28 and an annular sealing element 48 is mounted on neck portion 30, which sealing elements 46, 48 are mounted in collar 44 (FIGS. 5 & 6).

The shell 28 of the embodiments of FIGS. 5 and 6 do not have rigid end portions 42 nor central portion 40 as that of FIGS. 3 and 4. A central supporting area for back-up rolls 18, 20 is created by providing a center portion 50 in roll body 26 which abuts the inner peripheral surface of shell 28 parallel to the longitudinal axis of back-up rolls 18, 20. As mentioned above, in communication with annular chambers 38 are a series of radial passageways 52; two of which are shown on each end of back-up roll 18, 20 which in turn, communicate with an axial passageway 54 running longitudinally through the center of roll body 26 along the axes of back-up rolls 18, 20. Hydraulic fluid, such as oil, grease, or plasticized material is introduced into passageways 54, 52 and during the reduction stage for strip may be pressurized through any one of several well-known apparatuses, such as a rotary inlet as taught by U.S. Pat. No. 3,451,617 for a work roll or a rotary valve and piston cylinder assembly as taught by U.S. Pat. No. 4,062,096 which construction has particular application for a back-up roll.

The operation of both back-up rolls 18 and 20 is undertaken throughout the rolling process while the work rolls 14, 16 and back-up rolls 18 and 20 are rotating, and will be discussed in this light. As mentioned earlier, the reduction of strip 12 is being done according to the well-known practices which in addition to providing a camber on work rolls, includes screw-down and roll bending techniques to counteract the deflection of back-up rolls 18, 20 and/or work rolls 14, 16 caused by the rolling load of strip 12 by the rolls during the rolling process; and as mentioned above, without the teachings of the present invention these present day strip reduction practices produce the "edge drop" condition.

Without a sufficient amount of pressurized fluid in annular chambers 38 of back-up rolls 18, 20 these chambers 38 provide a soft region where the ends of strip 12 will not be worked. Therefore no sufficient reduction takes place at these end areas of strip 12 until the hydraulic fluid in annular chambers 38 is pressurized to the extent to obtain this result. The rolling load of strip 12 transmitted through work rolls 14 and 16 against the back-up roll ends and the variable and controllable pressure value of the hydraulic fluid will be such as to cause the end regions of back-up rolls 18, 20 to push against the work rolls, and thus against strip 12 to obtain a thickness along the edges of strip 12 which in a transverse cross-section along its width is almost but not quite the same thickness as the center area where a crown exists similar to that shown in FIG. 2. The effective pressure of the hydraulic fluid in annular chambers 38 in most cases, will be less than the total effective force applied by the rigid center area 40 or 50 of back-up rolls 18, 20 and against work rolls 14, 16 and strip 12; i.e. in effect, annular chambers 38 create a soft condition or a less reactive force producing area than the center of back-up rolls 18, 20 due to the ability to control and regulate the pressurized fluid therein.

A sealing condition for the hydraulic fluid in the construction for a back-up roll in FIGS. 5 and 6 is created through collar 44 containing sealing elements 46 and 48; whereas in the embodiment of FIGS. 3 and 4 the sealing condition is created by rigid ends 42 and/or central portions 40 where shell 28 is tightly mounted on roll body 26 by a shrunk fit, for example.

The variation of strip width which the present invention is capable of sufficiently and efficiently rolling is approximately equal to the back-up roll face minus approximately 50 inches.

From the above it can be appreciated that the "edge drop" phenomenon occurring when the conventional rolling methods for strip, including compensating for the bending of the rolls due to the rolling load are being employed is substantially reduced through the use of the present invention. The resultant force applied to the ends of the strip 12 can now be regulated due to the construction and operation of the back-up rolls 18, 20 of the present invention; the value of this resultant force being predetermined according to the different widths of strip and qualities of material so that through the rolling mill controls, the pressurized fluid required to produce a substantially uniform thickness strip across its width with a center crown is supplied into the ends of the back-up rolls.

Figure 8:
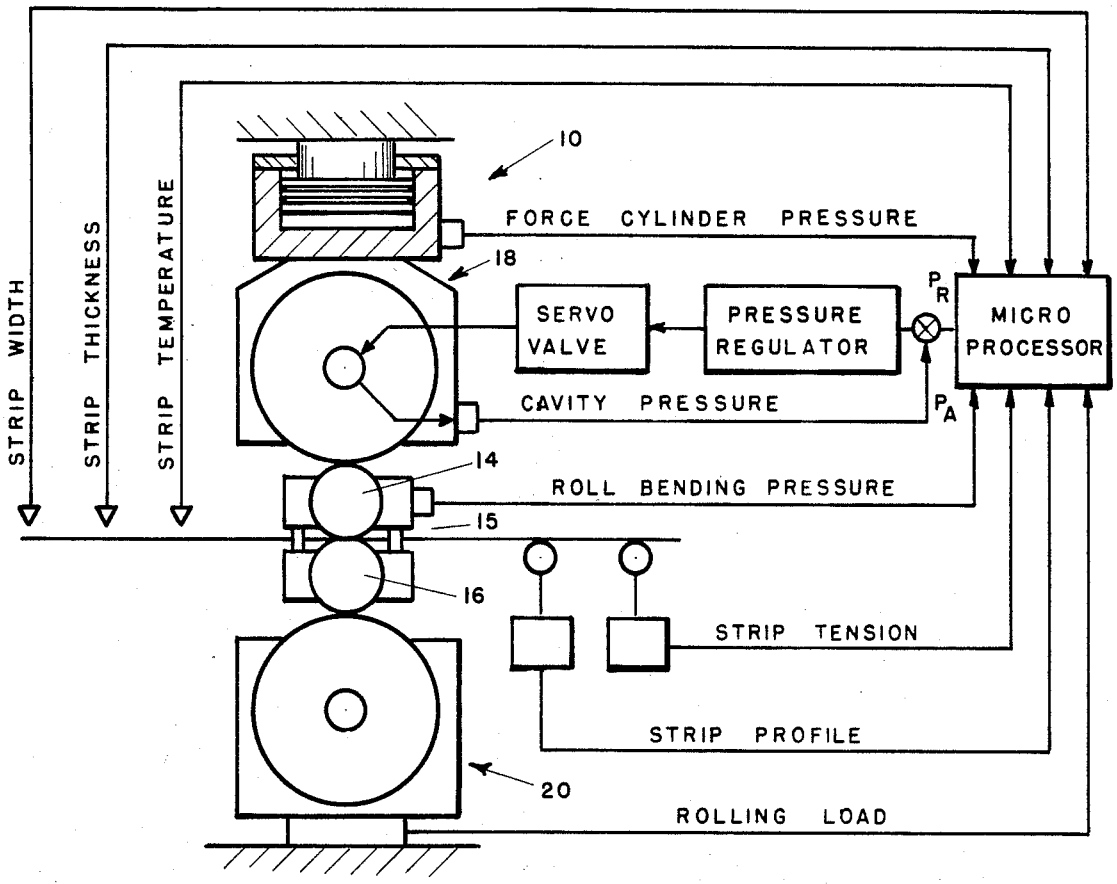
FIG. 8 is a schematic diagram illustrating a control for the operation of the present invention.

FIG. 8 illustrates a typical control system for regulating the pressure in chambers 38 of back-up rolls 18,20. Parameters of the strip 12 entering the stand 10 such as the width, thickness, and/or temperature of strip 12 prior to entering the stand 10 and parameters of the strip 12 exiting the stand 10, such as strip profile and tension as well as parameters for strip gauge such as the force cylinder pressure, roll bending pressure, and the rolling load are fed into a microprocessor. One or more of these parameters are used in the microprocessor to produce a reference pressure $P_R$ for chambers 38. This reference signal is compared through suitable devices with the actual pressure $P_A$ in chambers 38, and the difference between these two signals $P_R$ and $P_A$ is then amplified by a pressure regulator which controls an hydraulic servovalve, which adjusts the flow of the hydraulic fluid to chambers 38 striving to obtain a minimum difference between the required pressure $P_R$ and the actual pressure $P_A$. The pressure in each chamber 38 in each back-up roll 18, 20 can be controlled individually or simultaneously.

The finite element analysis of one example has shown that for a back-up roll deflection for a 13,608 psi rolling force, it was necessary to supply hydraulic fluid under approximately 750 psi to counteract the rolling load on the ends of the back-up rolls thereby producing the required reactive pressure to produce a strip profile substantially uniform in thickness except for a desired center crown when rolling a steel strip at approximately 72 inches in width for a 10% reduction in thickness.

Figure 9:
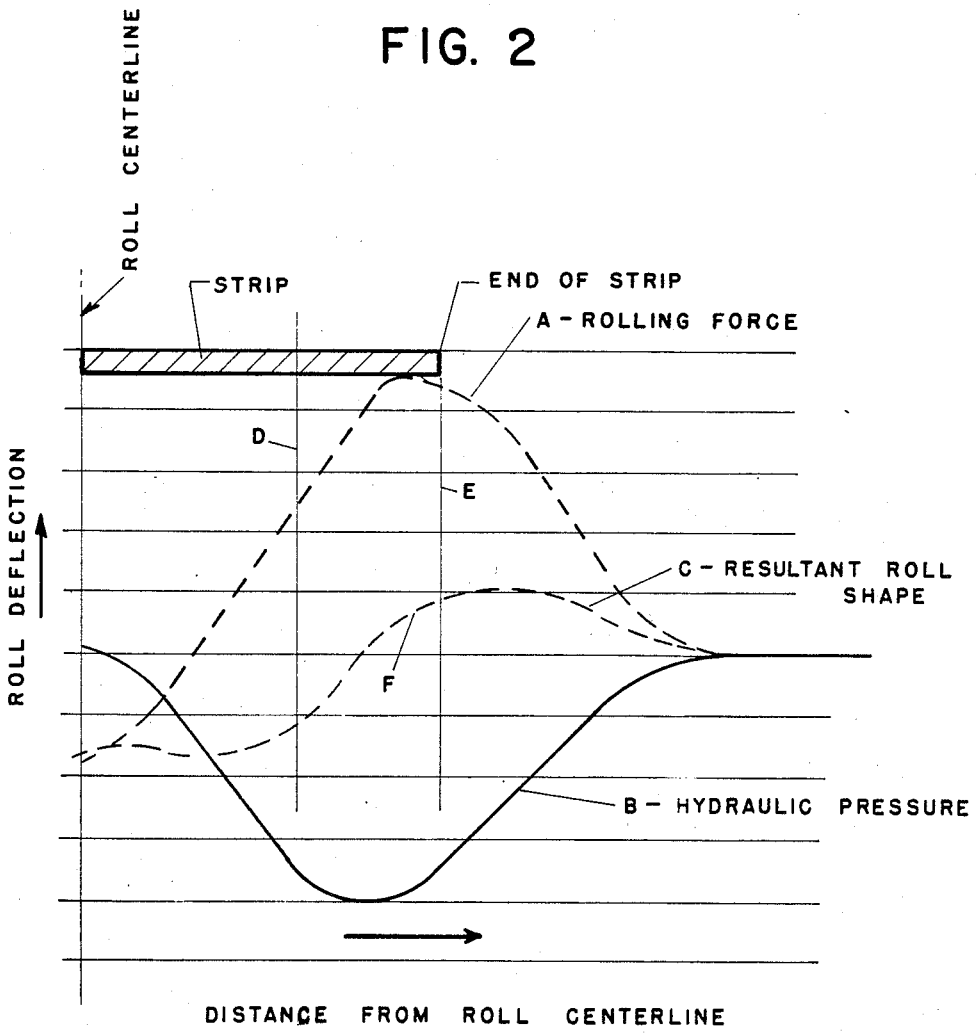
FIG. 9 is a schematic illustration of the back-up roll deflection curve due to rolling force and hydraulic pressure correcting force curve of the present invention and a curve of the result of the latter.

FIG. 9 shows the results of this example of the present invention where strip 12 is indicated at the top of this graph extending from the centerline of the back-up roll 18,20 and thus strip 12 to the edge of the strip 12. Curve A represents the 13,608 psi rolling force; curve B represents the 750 psi hydraulic fluid pressure supplied into chambers 38 of back-up rolls 18, 20; and curve C represents the resultant shape of back-up rolls 18,20 under the influence of curves A and B, where between vertical lines D and E this resultant shape works on the edges of strip 12, the counteracting pressure in chambers 38 of back-up rolls 18, 20 having the greatest effect at the extreme edges thereof as shown at point F along curve C in FIG. 9.

The vertical lines D and E in FIG. 9 correspond to those in FIG. 2, to indicate where along the width of strip 12, the operation of the present invention takes place, the outer dotted lines in FIG. 2 being the effect of the present invention.

It is noted that work rolls 14 and 16 similar in construction to back-up rolls 18, 20 can be used instead of or in addition to back-up rolls 18, 20, and a mill stand arrangement with more or less than four rolls can be used without falling out of the scope and spirit of the present invention. Also, the present invention is described for reducing a strip, however, other products such as plate or slab can be reduced instead of strip.

In accordance with the provisions of the patent statutes, we have explained the principle and operation of our invention and have illustrated and described what we consider to represent the best embodiments thereof.

We claim:

1. In a rolling mill stand for reducing a varying range product width, said product being a workpiece having two opposed longitudinal surfaces, a center, and two opposed longitudinal edges, said stand comprising:

at least two work rolls forming a roll gap to receive said workpiece for its said reduction, each said work roll arranged transversely of and having a working surface adapted to contact said workpiece along its width when said workpiece is in said gap for working a different one of said two opposed longitudinal surfaces thereof, a backup roll associated with each said work roll remote from said roll gap, and each said backup roll having a surface along its length adapted to substantially contact said working surface of its associated work roll and having a rigid central portion and opposed ends, at least one end of each backup roll arranged at opposed ends relative to each other having at least a partial generally annular chamber means formed adjacent the roll end portions of said contacting surface and coextensive with the associated edge of the workpiece when in said gap, said chamber means adapted to receive an adjustable amount of pressurized fluid when in an operative mode, said each work roll having a gradual taper area axially outward of its working surface and being on the same end of the work roll that said chamber means of the associated backup rolls are located and adjacent its working surface, said taper area overlapping a portion of said associated chamber means and ending near the end of said contacting surface of its said associated backup roll, said chamber means being coextensive with the line of demarcation between the said taper area and the working surface of the work rolls and adjacent the ends of the workpiece being rolled when in said roll gap, whereby when in said operative mode said taper area and said pressurized fluid in said chamber means operate in a cooperative manner to produce a controlled pressure distribution near said opposed edges of said workpiece in said roll gap which is less in value than that along said pressure center of said workpiece applied by said rigid central portion of said backup roll such as to reduce over rolling of the edges of said workpiece.

2. In a rolling mill stand according to claim 1, wherein said annular chamber means of said backup roll comprises several discrete axially aligned spaced apart zoned chambers adapted to receive the same or different said controllable pressurized fluid, and rigid means between said zoned chambers for transferring loads from said backup roll to said work roll, and further including means for delivering to said zoned chambers controllable pressurized fluid so selected that less pressure can be exerted in the area near the end of said workpiece and greater pressure can be exerted inward of said area.

3. In a rolling mill stand according to claim 1, wherein said annular chamber means has at least one closed end nearest to said rigid central portion of said backup roll and formed with at least one generally tapered surface which increases the opening of the chamber, which chamber would normally close as the rolling load increases in a direction of the outer end of said roll resulting in a varying length of contact between the opposed surfaces of said chamber means to cause said contacting surface adjacent said chamber means of said backup roll to apply said desired pressure against said work roll.

4. In a rolling mill stand according to claim 1, wherein said annular chamber means has a parabolic shaped cavity with a varying pressure transferring surface which tends to close said cavity as the rolling load increases.

5. In a rolling mill stand according to claim 1, wherein said annular chamber means has at least one closed end nearest to said rigid central portion of said backup roll and formed with at least one generally tapered surface which increases the opening of the chamber in a direction of the outer end of said roll resulting in a varying length of contact between the opposed surfaces of said chamber to decrease the leverage formed by said rigid portion and the outer end of said backup roll as a function of an increase in said applied pressure during said reduction of said workpiece, thereby to apply said desired pressure value against said associated work roll of said backup roll.

6. In a rolling mill stand for reducing a varying range of product width, said product being a workpiece having two opposed longitudinal surfaces, a center, and two opposed longitudinal edges, said stand comprising:

at least two work rolls forming a roll gap to receive said workpiece for its said reduction, each said work roll arranged transversely of and having a working surface adapted to contact said workpiece along its width when said workpiece is in said gap for working a different one of said two opposed longitudinal surfaces thereof, a backup roll associated with each said work roll remote from said roll gap, said each backup roll having a surface along its length adapted to substantially contact said working surface of its associated work roll, at least one said backup roll having a rigid central portion and opposed ends and having at least a generally annular chamber means at each said opposed ends formed adjacent the roll end portion of said contacting surface and coextensive with the associated edge of the workpiece when in said gap, said chamber means adapted to receive an adjustable amount of pressurized fluid when in an operative mode, said work roll associated with said at least one backup roll having a gradually extended taper area axially outward of and adjacent to its working surface, said taper area overlapping a portion of said associated chamber means and ending near the associated end of said contacting surface of said at least one backup roll, said chamber means being coextensive with the line of demarcation between said taper area and said working surface of said work roll associated with said at least one backup roll and adjacent the ends of the workpiece being rolled when in said roll gap whereby when in said operative mode said taper area and said pressurized fluid in said chamber means operate in a cooperative manner to produce a controlled pressure distribution near said opposed edges of said workpiece in said roll gap which pressure is progressively less in value than that along said center of said workpiece applied by said rigid center portion of said backup roll such as to reduce over rolling of the edges of said workpiece.

7. In a rolling mill stand according to claim 6, wherein said annular chamber means of said at least backup roll comprises several discrete axially aligned spaced apart zoned chambers adapted to receive the same or different said controllable pressurized fluid, and rigid means between said zoned chambers for transferring loads from said backup roll to said work roll, and further including means for delivering to said zoned chambers controllable pressurized fluid so selected that less pressure can be exerted in the area near the end of said workpiece and greater pressure can be exerted inward of said area.

8. In a rolling mill stand according to claim 6, wherein said annular chamber means has at least one closed end nearest to said rigid central portion of said backup roll and formed with at least one generally tapered surface which increases the opening of the chamber, which chamber would normally close as the rolling load increases in a direction of the outer end of said roll resulting in a varying length of contact between the opposed surfaces of said chamber to cause said contacting surface adjacent said chamber of said backup roll to apply said desired pressure against said associated work roll.

9. In a rolling mill stand according to claim 6, wherein said annular chamber means has a parabolic shaped cavity with a varying pressure transferring surface which tends to close said cavity as the rolling load increases.

10. In a rolling mill stand according to claim 6, wherein said annular chamber means has at least one closed end nearest to said rigid central portion of said at least one backup roll and formed with at least one generally tapered surface which increases the opening of the chamber in a direction of the outer end of said roll resulting in a varying length of contact between the opposed surfaces of said chamber to decrease the leverage formed by said rigid portion and the outer end of said roll as a function of an increase in said applied pressure during said reduction of said workpiece, thereby to apply said desired pressure value against said associated work roll of said at least one backup roll.

* * * * *